US012527396B2

(12) United States Patent
Fan

(10) Patent No.: US 12,527,396 B2
(45) Date of Patent: Jan. 20, 2026

(54) MULTI-PURPOSE DESK

(71) Applicant: Jsyard Home Technology Co., LTD, Zhejiang (CN)

(72) Inventor: Weiping Fan, Zhejiang (CN)

( * ) Notice: Subject to any disclaimer, the term of this patent is extended or adjusted under 35 U.S.C. 154(b) by 60 days.

(21) Appl. No.: 18/535,709

(22) Filed: Dec. 11, 2023

(65) Prior Publication Data

US 2025/0143452 A1 May 8, 2025

(30) Foreign Application Priority Data

Nov. 2, 2023 (CN) ..... 202311448580.6

(51) Int. Cl.
*A47B 21/00* (2006.01)
*A47B 21/03* (2006.01)

(52) U.S. Cl.
CPC .. *A47B 21/0314* (2013.01); *A47B 2021/0321* (2013.01); *A47B 2200/0066* (2013.01)

(58) Field of Classification Search
CPC ..... A47B 21/00; A47B 21/0314; A47B 21/06; A47B 17/00; A47B 19/00; A47B 13/081; A47B 83/001; A47B 83/04; A47B 88/919; A47B 2021/0321; A47B 2021/0335; A47B 2200/0066
USPC ..... 312/194–196, 223.3, 223.6, 231, 232; 108/6, 7, 9, 50.01, 50.02
See application file for complete search history.

(56) References Cited

U.S. PATENT DOCUMENTS 1,851,299 A * 3/1932 Banks ..... A47B 85/02 108/9
1,925,771 A * 9/1933 Miller ..... A47B 17/02 108/166
2,683,067 A * 7/1954 Hartman ..... A47B 19/06 108/7
2,843,226 A * 7/1958 Nordmark ..... A47B 41/04 108/6
4,700,993 A * 10/1987 Fu-Long ..... A47B 51/00 312/196
4,766,422 A * 8/1988 Wolters ..... G06F 1/16 348/836
4,781,126 A * 11/1988 Lochridge ..... A47B 21/03 108/90
4,948,205 A * 8/1990 Kelley ..... A47B 21/06 D6/648

(Continued)

FOREIGN PATENT DOCUMENTS

CN 108391953 A * 8/2018 ..... A47C 19/22
KR 20180001603 U * 5/2018 ..... A47B 21/03
WO WO-2006128218 A1 * 12/2006 ..... A47B 21/06

*Primary Examiner* — Janet M Wilkens

(57) ABSTRACT

Disclosed is a multi-purpose desk, comprising a desk body and legs; the bottom of the desk body is fixed on the ground through the legs; the middle of the lower part of the desk body is provided with a hollow chamber, the upper parts of both sides of the desk body are provided with drawer parts, and both sides of the desk body are provided with storage cabinets below the drawer parts; the upper part of the desk body is provided with a keyboard chamber, and the keyboard chamber is movably provided with a keyboard drawer; the end of the keyboard drawer is rotatably provided with a drawer panel matched with the keyboard drawer through a magnetic lock; the keyboard chamber is provided with supporting plates on both sides of the keyboard drawer.

6 Claims, 8 Drawing Sheets

(56) References Cited

U.S. PATENT DOCUMENTS

| | | | | | |
|---|---|---|---|---|---|
| 5,101,736 | A * | 4/1992 | Bommarito | A47B 21/02 | 312/194 |
| 5,758,934 | A * | 6/1998 | Flutka | A47B 21/007 | 108/50.01 |
| 5,878,673 | A * | 3/1999 | Kramer | A47B 87/002 | 108/50.02 |
| 6,126,253 | A * | 10/2000 | Kelley | A47B 17/006 | 312/195 |
| 6,216,606 | B1 * | 4/2001 | Kathardekar | A47B 21/06 | 108/50.02 |
| 6,609,465 | B2 * | 8/2003 | Kolavo | A47B 21/0073 | 108/50.01 |
| 2003/0076014 | A1 * | 4/2003 | Kelley | A47B 97/08 | 312/194 |
| 2005/0062370 | A1 * | 3/2005 | Miller | A47B 49/004 | 312/208.1 |
| 2006/0201894 | A1 * | 9/2006 | Wood | B29C 45/14065 | 211/10 |
| 2007/0247037 | A1 * | 10/2007 | Schenker | A47B 88/975 | 312/348.3 |
| 2009/0050028 | A1 * | 2/2009 | Liao Fang | A47B 13/12 | 108/26 |
| 2010/0314980 | A1 * | 12/2010 | Hoffman | E05D 15/58 | 312/322 |
| 2012/0161597 | A1 * | 6/2012 | Daniels | A47B 21/00 | 312/326 |

* cited by examiner

MULTI-PURPOSE DESK

1. TECHNICAL FIELD

The invention relates to the technical field of furniture, and specifically refers to a multi-purpose desk.

2. BACKGROUND ART

A desk refers to a table equipped for the convenience of work in daily life and social activities. Office workers need to use desks when working. With the development of science and technology, desks are becoming more and more diverse.

Ordinary desks generally adopt an integrated structure, and their appearance is difficult to change, making it difficult to expand their uses. In most situations, the desktop of the desk needs to be kept level. However, in painting or engineering drawing, it is more convenient to keep the desktop at an inclined angle. If desks are prepared according to different uses, some office equipment will be left idle, resulting in waste, and the idle office equipment will take up space.

With the popularity of laptop computers, more and more people use laptop computers to work and study at their desks. When the laptop is placed on the desk, the keyboard of the laptop is always parallel to the desktop; however, the desktop of the existing desk is parallel to the ground; therefore, the keyboard of the laptop should always be placed parallel to the ground. Operating in this way for a long time will cause pain in the neck and back of the staff. In order to improve the comfort of operating the keyboard, it is often necessary to adjust the angle at which the keyboard of the laptop is placed. However, the angle of the desktop of the existing desk cannot be adjusted.

At the same time, with the continuous increase of electronic products, the number of power connection cords for various office equipment is also increasing. Various charging cords of different thicknesses and shapes are often piled up on the desk in an orderly manner. However, the existing methods of classifying power cords cannot fully satisfy our classification and arrangement of various types of power cords, and various messy scenes appear on the office desk.

Therefore, a multi-purpose desk is proposed to solve the existing deficiencies.

3. SUMMARY OF THE INVENTION

The technical problem to be solved by the invention is to overcome the defects of the above technology and provide a multi-purpose desk.

In order to solve the above technical problems, the technical solutions provided by the invention are: a multi-purpose desk, comprising a desk body and legs;

the bottom of the desk body is fixed on the ground through the legs; the middle of the lower part of the desk body is provided with a hollow chamber, the upper parts of both sides of the desk body are provided with drawer parts, and both sides of the desk body are provided with storage cabinets below the drawer parts;

the upper part of the desk body is provided with a keyboard chamber, and the keyboard chamber is movably provided with a keyboard drawer; the end of the keyboard drawer is rotatably provided with a drawer panel matched with the keyboard drawer through a magnetic lock; the keyboard chamber is provided with supporting plates on both sides of the keyboard drawer; the desktop of the desk body is movably provided with a flipped desk plate located in the keyboard chamber; the flipped desk plate is movably connected to the supporting plates through hydraulic dampers, and the flipped desk plate is lifted by the hydraulic dampers; the flipped desk plate is provided with a removable bookend;

the upper rear side of the desk body is provided with wiring closets, and the desk body is rotatably provided with flipped plates matched with the wiring closets.

As an improvement, the drawer part comprises at least one drawer provided along the height direction of the desk body.

As an improvement, the rear end of any of the drawers is provided with a socket with a USB interface.

As an improvement, the storage cabinet is rotatably connected with a cabinet door; the inside of the storage cabinet on either side is provided with a connecting plate, and the corresponding cabinet door is connected to the connecting plate; the cabinet door is provided with a magnetic pen holder.

As an improvement, the wiring closet is provided with partitions corresponding to the drawer parts and the keyboard chamber to form a number of wiring cavities; the partition is provided with a through hole; the number of the flipped plates is the same as the number of the wiring cavities, and the flipped plates are adapted to the wiring cavities As an improvement, the inside of the flipped plate is provided with a cork layer.

As an improvement, the supporting plate is located at one end of the keyboard chamber close to the drawer panel and is in contact with the drawer panel.

The advantages of the invention compared with the prior art are:

1. through the setting of drawers and storage cabinets, the storage space of the desk is increased, and items can be classified and stored;
2. through the setting of sockets in the drawer, it is convenient to charge the electronic products stored in the drawer, and avoid the clutter caused by placing too many items on the desk; at the same time, through the setting of the magnetic pen holder on the cabinet door, the placement position of the magnetic pen holder can be set according to actual needs;
3. the flipped desk plate can be set at any angle through the hydraulic damper, which can meet the needs of use in different situations and prevent users from maintaining the same posture for a long time;
4. through the wiring closets and matching flipped plates, the hidden storage of wires is realized, and the interior can also be used as a storage space; the cork layer provided on the flipped plate can be used to set up a tool rack to achieve the function of placing tools to be used.

4. BRIEF DESCRIPTION OF ACCOMPANY DRAWINGS

Figure 1:
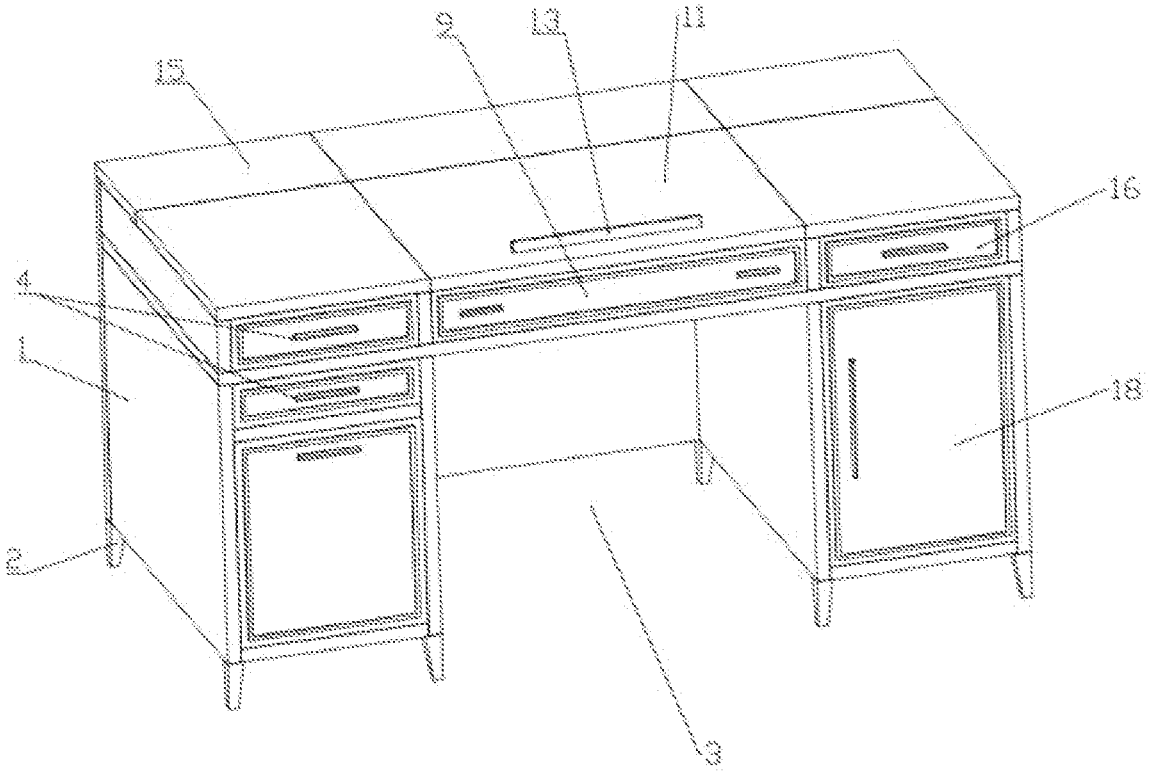
FIG. 1 is a schematic structural diagram of the multi-purpose desk according to the invention.
Figure 2:
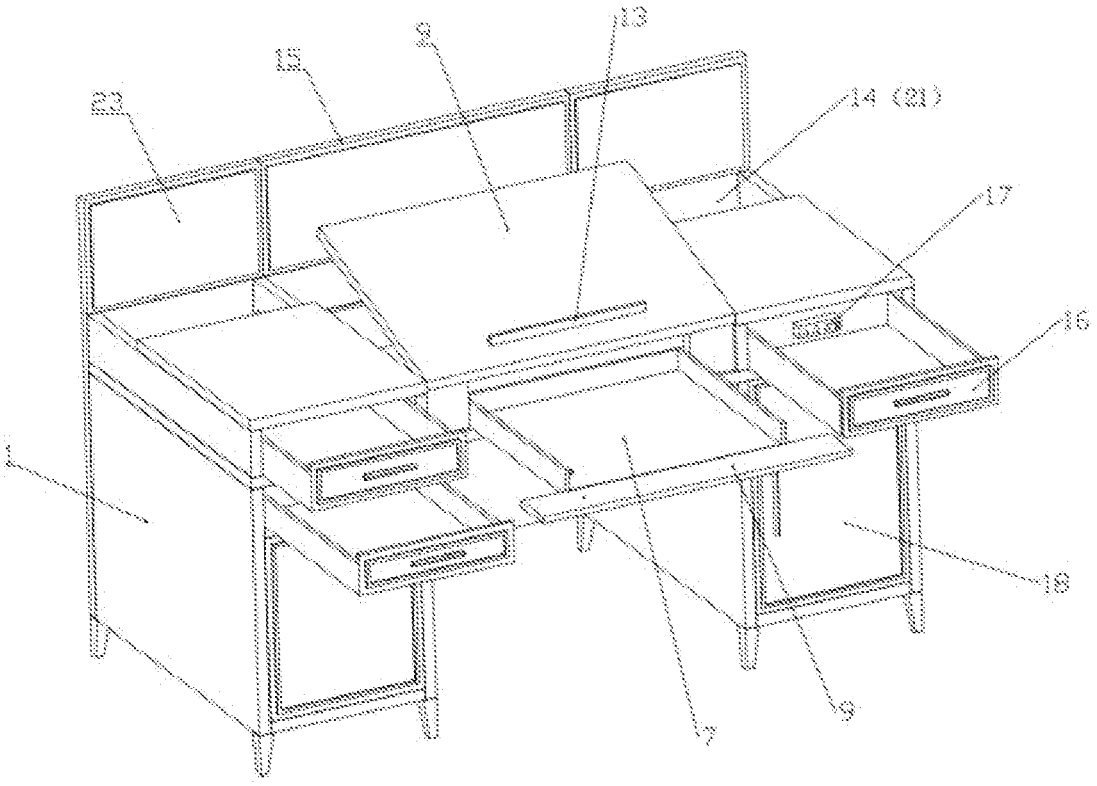
FIG. 2 is a schematic structural diagram of the multi-purpose desk in an unfolded state according to the invention.
Figure 3:
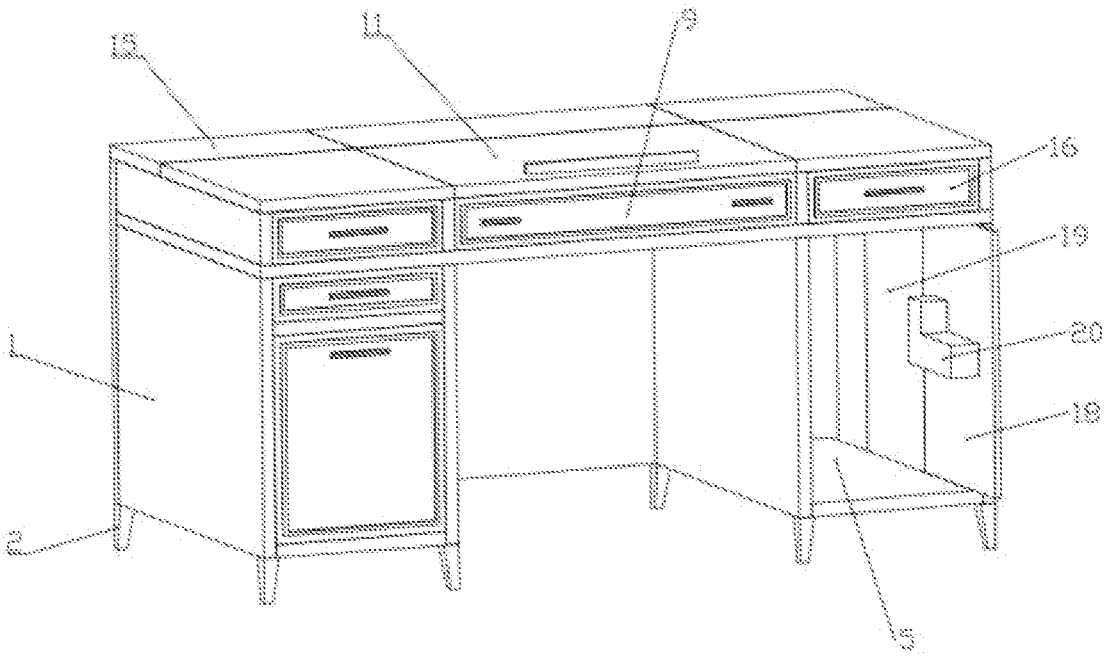
FIG. 3 is a schematic structural diagram of the cabinet door with the magnetic pen holder in an unfolded state in the multi-purpose desk according to the invention.
Figure 4:
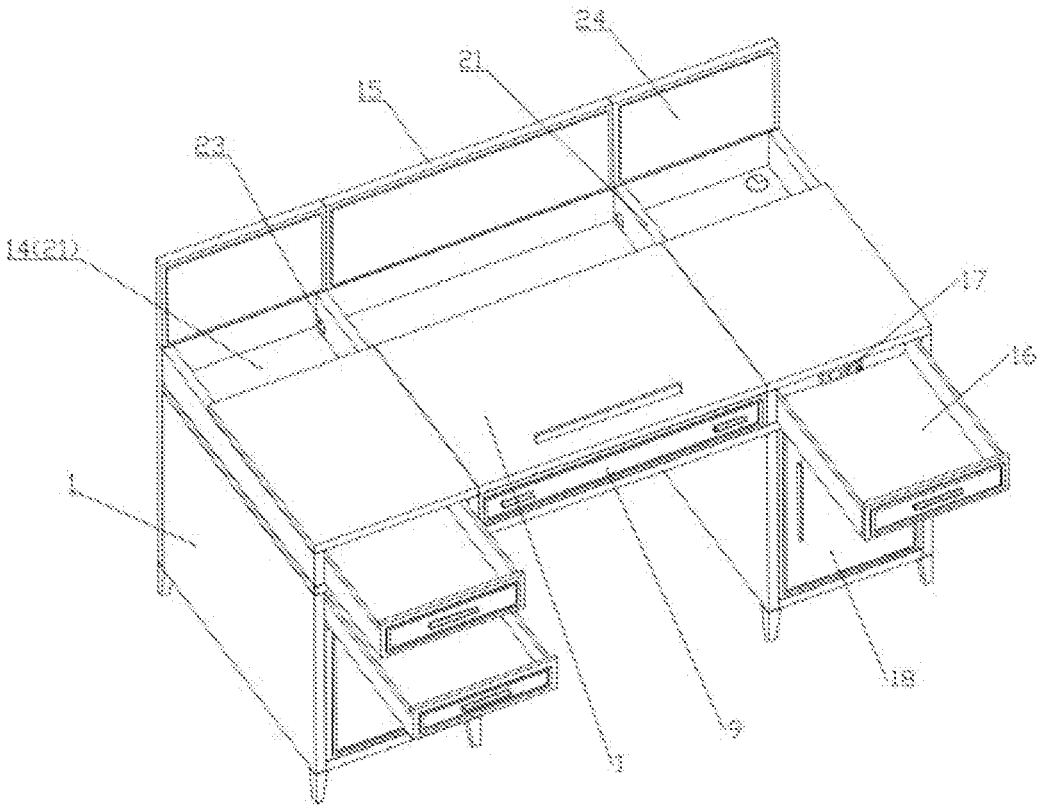
FIG. 4 is a schematic structural diagram of the drawer part and the flipped plate in an unfolded state in the multi-purpose desk according to the invention.
Figure 5:
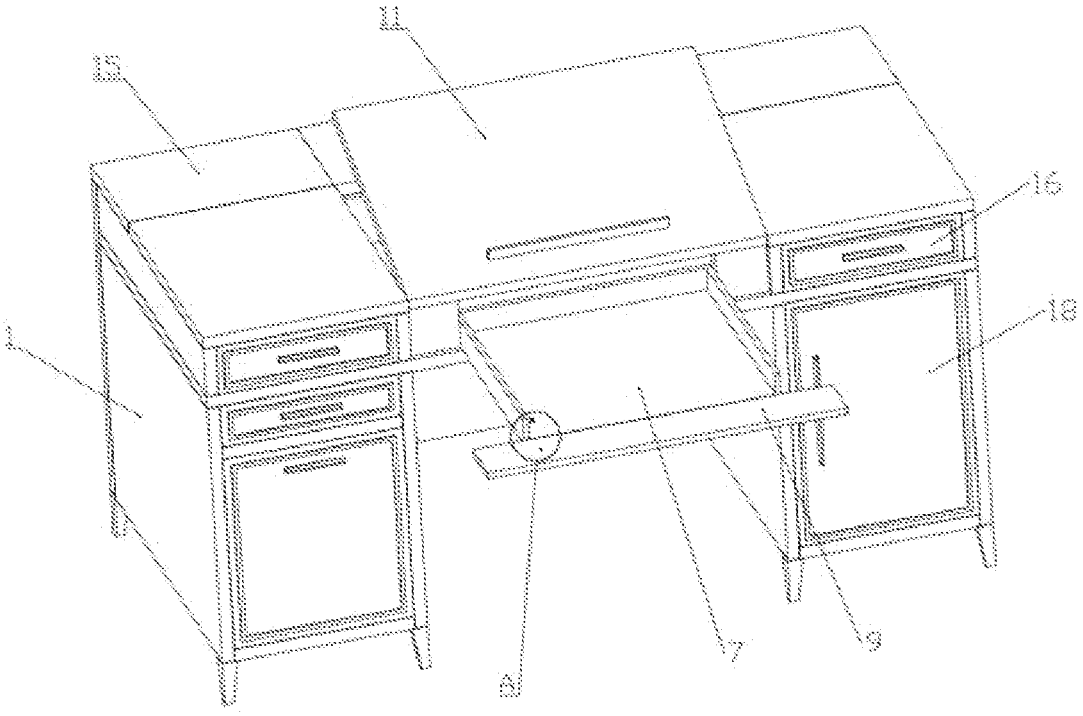
FIG. 5 is a first structural diagram of the flipped desk plate and the keyword drawer in an unfolded state in the multi-purpose desk according to the invention.
Figure 6:
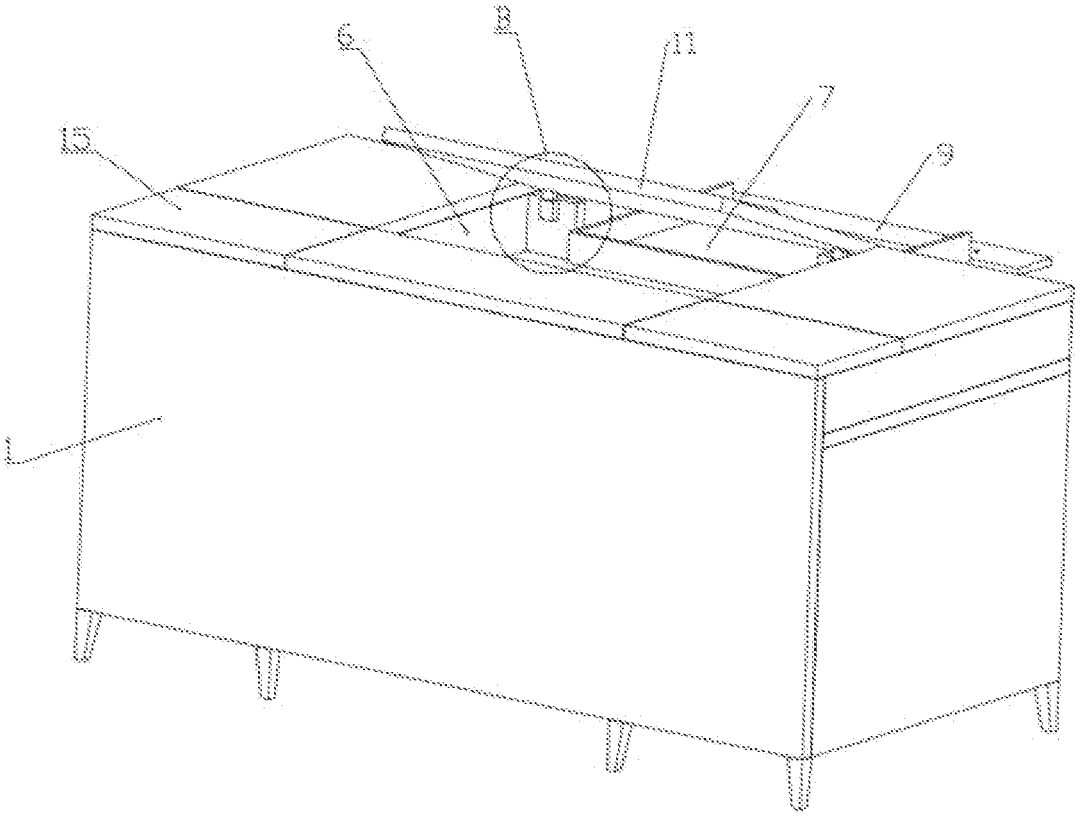
FIG. 6 is a second structural diagram of the flipped desk plate and the keyword drawer in an unfolded state in the multi-purpose desk according to the invention.
Figure 7:
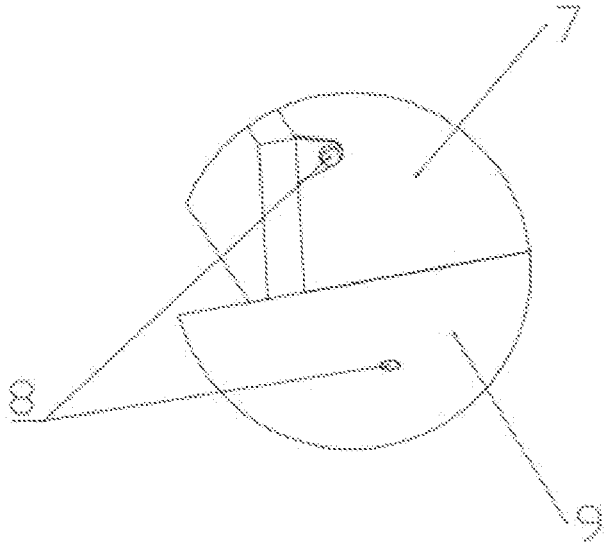
FIG. 7 is a partial enlarged view of part A in FIG. 5.
Figure 8:
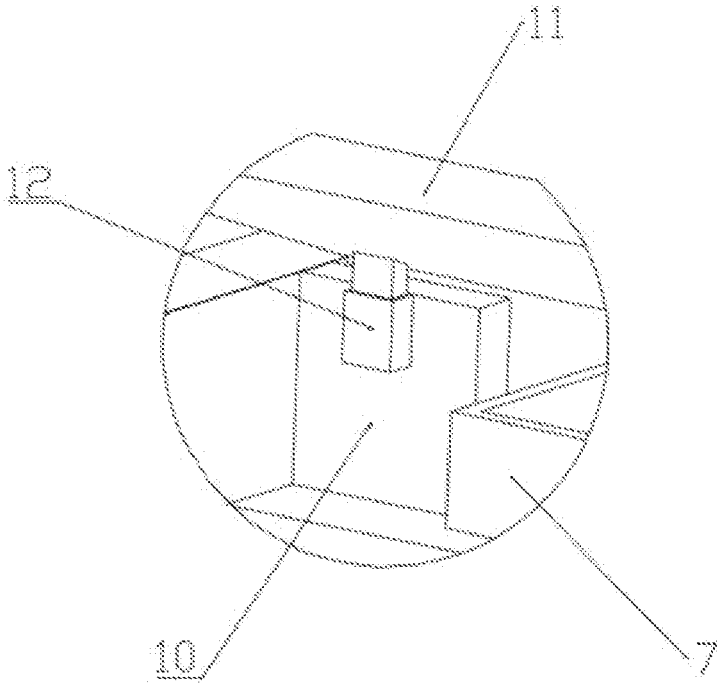
FIG. 8 is a partial enlarged view of part B in FIG. 6.

As shown in the figures: 1 refers to the desk body; 2 refers to the leg; 3 refers to the hollow chamber; 4 refers to the drawer part; 5 refers to the storage cabinet; 6 refers to the keyboard chamber; 7 refers to the keyboard drawer; 8 refers to the magnetic lock; 9 refers to the drawer panel; 10 refers to the supporting plate; 11 refers to the flipped desk plate; 12 refers to the hydraulic damper; 13 refers to the bookend; 14 refers to the wiring closet; 15 refers to the flipped plate; 16 refers to the drawer; 17 refers to the socket; 18 refers to the cabinet door; 19 refers to the connecting plate; 20 refers to the magnetic pen holder; 21 refers to the partition; 22 refers to the wiring cavity; 23 refers to the through hole; 24 refers to the cork layer.

5. SPECIFIC EMBODIMENT OF THE INVENTION

In order to make the objectives, technical solutions, and advantages of the embodiments of the invention clearer, the technical solutions in the embodiments of the invention will be described clearly and completely hereinafter with reference to the drawings in the embodiments of the invention. Obviously, the described embodiments are part of the embodiments of the invention, rather than all of the embodiments. The components of the embodiments of the invention generally described and illustrated in the drawings herein may be arranged and designed in various different configurations.

In the description of the invention, it needs to be understood that the orientation or positional relationship indicated by the terms "center", "up", "down", "left", "right", "vertical", "horizontal", "inner", "outer", etc. are based on the orientation or positional relationship shown in the drawings, which are only for the convenience of describing the invention and simplifying the description, rather than indicating or implying that the device or element referred to must have a specific orientation, be constructed and operated in a specific orientation, and therefore cannot be understood as a limitation of the invention. In addition, the terms "first", "second", and "third" are only used for descriptive purposes, and cannot be understood as indicating or implying relative importance or implicitly indicating the number of indicated technical features.

In addition, the terms "horizontal", "vertical", "dangling", etc. do not mean that the component is required to be absolutely horizontal or hanging, but may be slightly inclined. For example, "horizontal" only means that its direction is more horizontal than "vertical", it does not mean that the structure must be completely horizontal, but can be slightly inclined.

In the description of the invention, "plurality" means at least two.

In the invention, unless otherwise clearly defined and limited, the terms "provided", "installed", "connected" and other terms should be interpreted broadly; for example, it can be a fixed connection, it can be a detachable connection, or integrated; it can be a mechanical connection or an electrical connection; it can be a direct connection, or an indirectly connection through an intermediate medium, and it can be an internal communication between two elements or the interaction relationship between two elements. For those of ordinary skill in the art, the specific meaning of the above terms in the invention can be understood according to specific circumstances.

With reference to the drawings, a multi-purpose desk, comprising a desk body 1 and legs 2;

the bottom of the desk body 1 is fixed on the ground through the legs 2; the middle of the lower part of the desk body 1 is provided with a hollow chamber 3; the setting of the hollow chamber 3 facilitates the placement of the user's legs, and the size of the hollow chamber 3 can be set according to the width of the keyboard chamber 6;

the upper parts of both sides of the desk body 1 are provided with drawer parts 4;

specifically, the drawer part 4 comprises at least one drawer 16 provided along the height direction of the desk body 1;

In the embodiment, the number of drawers 16 located on the left side of the desk body 1 is two, and the number of drawers 16 located on the right side of the desk body 1 is one.

Further, the rear end of any of the drawers 16 is provided with a socket 17 with a USB interface; in the embodiment, the socket 17 is located in the drawer 16 on the right; the setting of the socket 17 can realize the charging operation of the electronic products when the electronic products are placed in the drawer 16, which can avoid the clutter caused by placing too many items on the desk, and can also avoid the clutter of the wires.

both sides of the desk body 1 are provided with storage cabinets 5 below the drawer parts 4; specifically, the height of the storage cabinet 5 located on the right side of the desk body 1 is greater than the height of the storage cabinet 5 located on the left side of the desk body 1; in actual use, the storage cabinet 5 located on the right side of the desk body 1 can be used to place the computer host, and the storage cabinet 5 located on the left side of the desk body 1 is equipped with a lock and can be used to place other items; in the embodiment, sketchbooks can be placed vertically in the storage cabinet 5 located on the left side of the desk body 1.

Further, the storage cabinet 5 is rotatably connected with a cabinet door 18; the inside of the storage cabinet 5 on either side is provided with a connecting plate 19, and the corresponding cabinet door 18 is connected to the connecting plate 19; the cabinet door 18 is provided with a magnetic pen holder 20.

In the embodiment, the connecting plate 19 is arranged in the storage cabinet 5 located on the right side of the desk body 1, and is rotatably connected to the cabinet door 18 and the connecting plate 19; when the cabinet door 18 is in an open state, the cabinet door 18 and the connecting plate 19 are located on the same plane; at this time, the cabinet door 18 can enter the storage cabinet 5 with the movement of the connecting plate 19 to realize space utilization; at the same time, the outside of the cabinet door 18 is vertically provided with a handle; through the contact of the handle with the desk body 1, the distance between the cabinet door 18 and the inside of the storage cabinet 5 can be restricted;

At the same time, the cabinet door 18 connected to the connecting plate 19 is provided with a magnetic pen holder 20; the magnetic pen holder 20 is detachably connected to the cabinet door 18 and can be directly placed on the cabinet door 18 for use; at the same time, the magnetic pen holder 20 can also be removed from the cabinet door 18 and placed on the desktop of the desk body 1 for use.

the upper part of the desk body 1 is provided with a keyboard chamber 6, and the keyboard chamber 6 is movably provided with a keyboard drawer 7; the keyboard drawer 7 is used to place the keyboard and realize hidden storage of the keyboard; the end of the keyboard drawer 7 is rotatably provided with a drawer panel 9 matched with the keyboard drawer 7 through a magnetic lock 8; the drawer panel 9 is adapted to the drawer chamber 6 to seal the drawer chamber 6 and ensure the cleanliness of the drawer chamber 6.

In specific implementation, the drawer chamber 6 is adapted to the drawer panel 9 to realize the closed placement of the keyboard drawer 7; at the same time, the drawer panel 9 rotates with the keyboard drawer 7 so that when the keyboard drawer 7 is opened, the drawer panel 9 can be flipped down to avoid affecting the use of the keyboard due to the setting of the drawer panel 9; at the same time, putting down the drawer panel 9 can further support the hand. In addition, the keyboard drawer 7 is connected to the drawer panel 9 through a magnetic lock 8, which facilitates the opening and closing of the drawer panel 9 and the keyboard drawer 7.

The keyboard chamber 6 is provided with supporting plates 10 on both sides of the keyboard drawer 7; specifically, the supporting plate 10 is located at one end of the keyboard chamber 6 close to the drawer panel 9 and is in contact with the drawer panel 9; the supporting plates 10 are in contact with the drawer panel 9, which can further ensure the position stability of the keyboard drawer 7 in the closed state; at the same time, the supporting plates 10 are also used as supports for the flipped desk plate 11 to be flipped.

The desktop of the desk body 1 is movably provided with a flipped desk plate 11 located in the keyboard chamber 6; under normal conditions, the flipped desk plate 11 is flush with the desktop of the desk body 1 to form a complete rectangular desktop; when the flipped desk plate 11 is flipped, the flipped desk plate 11 can be flipped upward to form an inclined desktop with a certain angle with the desktop of the desk body 1 for use.

The flipped desk plate 11 is movably connected to the supporting plates 10 through hydraulic dampers 12, and the flipped desk plate 11 is lifted by the hydraulic dampers 12; specifically, the hydraulic dampers 12 are located at both ends of the flipped desk plate 11 and are respectively connected to the corresponding supporting plates 10; by pulling the end of the flipped desk plate 11 away from the hydraulic dampers 12 and coordinating with the action of the hydraulic dampers 12, the flipping of the flipped desk plate 11 can be realized; at the same time, due to the setting of the hydraulic dampers 12, the flipped desk plate 11 and the desk body 1 can be set and hovered at any angle, which is convenient for use.

The flipped desk plate 11 is provided with a removable bookend 13; the bookend 13 is in the shape of a long strip; the bookend 13 is arranged along the length direction of the flipped desk plate 11 and close to one end of the supporting plates 10; the bookend 13 and the flipped desk plate 11 are detachably connected; in the embodiment, the bookend 13 and the flipped desk plate 11 are connected through magnetic attraction components. Specifically, when the flipped desk plate 11 is tilted, bookend 13 can be provided to position items placed on the flipped desk plate 11.

The upper rear side of the desk body 1 is provided with wiring closets 14; the wiring closets 14 are arranged along the length direction of the desk body 1; the wiring closets 14 can realize the hidden arrangement of wires, avoid the messy placement of wires on the desktop of the desk body 1, and ensure the cleanliness of the desktop of the desk body 1 while ensuring its safety.

In addition, the wiring closets 14 can also be used as storage spaces, so that some necessary but rarely used tools can be placed in the wiring closets 14 for convenient use.

The desk body 1 is rotatably provided with flipped plates 15 matched with the wiring closets 14, and the flipped plates 15 seals the wiring closets 14 and ensures the integrity of the desktop of the desk body 1.

Specifically, the wiring closet 14 is provided with partitions 21 corresponding to the drawer parts 4 and the keyboard chamber 6 to form a number of wiring cavities 22; the partition 21 is provided with a through hole 23; the number of the flipped plates 15 is the same as the number of the wiring cavities 22, and the flipped plates 15 are adapted to the wiring cavities 22.

In actual use, the arrangement of corresponding wiring cavities 22 and through holes 23 can facilitate wiring according to actual needs; at the same time, the arrangement of multiple wiring cavities 22 can also facilitate the classification and placement of items to be placed for easy access.

Further, the inside of the flipped plate 15 is provided with a cork layer 24; specifically, the cork layer 24 can facilitate the installation and setting of the tool rack; when in use, the flipped plates 15 can be flipped upward to be vertically arranged with the desktop of the desk body 1; the cork layer 24 implements the setting of a tool rack to facilitate the placement of tools to be used and the subsequent use of the tools.

The invention and the embodiments thereof are described hereinabove, and this description is not restrictive. What is shown in the drawings is only one of the embodiments of the invention, and the actual structure is not limited thereto. All in all, structural methods and embodiments similar to the technical solution without deviating from the purpose of the invention made by those of ordinary skill in the art without creative design shall all fall within the protection scope of the invention.

What is claimed is:

1. A multi-purpose desk, comprising a desk body (1) and legs (2);

the bottom of the desk body (1) is fixed on the ground through the legs (2); the middle of the lower part of the desk body (1) is provided with a hollow chamber (3), the upper parts of both sides of the desk body (1) are provided with drawer parts (4), and both sides of the desk body (1) are provided with storage cabinets (5) below the drawer parts (4);

the upper part of the desk body (1) is provided with a keyboard chamber (6), and the keyboard chamber (6) is movably provided with a keyboard drawer (7); the end of the keyboard drawer (7) is rotatably provided with a drawer panel (9) matched with the keyboard drawer (7) through a magnetic lock (8); the keyboard chamber (6) is provided with supporting plates (10) on both sides of the keyboard drawer (7); the desktop of the desk body (1) is movably provided with a flipped desk plate (11) located in the keyboard chamber (6);

the flipped desk plate (11) is movably connected to the supporting plates (10) through hydraulic dampers (12), and the flipped desk plate (11) is lifted by the hydraulic dampers (12); the flipped desk plate (11) is provided with a removable bookend (13);

the upper rear side of the desk body (1) is provided with wiring closets (14), and the desk body (1) is rotatably provided with flipped plates (15) matched with the wiring closets (14);

wherein the each of the supporting plates (10) is located at one end of the keyboard chamber (6) close to the drawer panel (9) and is in contact with the drawer panel (9).

2. The multi-purpose desk of claim 1, wherein each of the drawer part (4) comprises at least one drawer (16) provided along the height direction of the desk body (1).

3. The multi-purpose desk of claim 2, wherein the rear end of any of the drawers (16) is provided with a socket (17) with a USB interface.

4. The multi-purpose desk of claim 1, wherein one of the storage cabinets (5) is rotatably connected with a cabinet door (18); the inside of the storage cabinet (5) on either side is provided with a connecting plate (19), and the corresponding cabinet door (18) is connected to the connecting plate (19); the cabinet door (18) is provided with a magnetic pen holder (20).

5. The multi-purpose desk of claim 1, wherein the wiring closets (14) are provided with partitions (21) corresponding to the drawer parts (4) and the keyboard chamber (6) to form a number of wiring cavities (22); the partition (21) is provided with a through hole (23); the number of the flipped plates (15) is the same as the number of the wiring cavities (22), and the flipped plates (15) are adapted to the wiring cavities (22).

6. The multi-purpose desk of claim 5, wherein the inside of the each of the flipped plates (15) is provided with a cork layer (24).

* * * * *